United States Patent [19]

Bitner

[11] 4,189,628

[45] Feb. 19, 1980

[54] TIME DELAY SWITCH

[76] Inventor: Everett D. Bitner, R.R. #1, Box 160, Trivoli, Ill. 61569

[21] Appl. No.: 856,162

[22] Filed: Nov. 30, 1977

[51] Int. Cl.[2] ..... H01H 43/00

[52] U.S. Cl. ..... 200/33 R; 200/308

[58] Field of Search ..... 200/33 R, 33 A, 34, 200/61.53, 308, 277; 267/113, 114

[56] References Cited

U.S. PATENT DOCUMENTS

| | | | |
|---|---|---|---|
| 2,651,166 | 9/1953 | Dorfman | 200/34 X |
| 2,800,538 | 7/1957 | Kuhn | 200/34 |
| 3,155,785 | 11/1964 | Frey | 200/33 R |
| 3,375,335 | 3/1968 | Schultz | 200/33 R |
| 3,548,124 | 12/1970 | Tollerud et al. | 200/34 |

*Primary Examiner*—James R. Scott

*Attorney, Agent, or Firm*—Clarence A. O'Brien; Harvey B. Jacobson

[57] ABSTRACT

A time delay switch has a hollow housing forming a liquid reservoir and having slidably disposed thereon an actuator movable between a switch open position and a switch closed position. The actuator is biased as by a suitable spring toward one of the switch open position and the switch closed position so that the actuator can be preset to one position so as to permit movement of the actuator toward the other position through the liquid reservoir under the bias of the spring in a predetermined period of time.

9 Claims, 4 Drawing Figures

TIME DELAY SWITCH

BACKGROUND OF THE INVENTION

1. Field of the Invention

This invention relates generally to switches, and particularly to a time delay switch using the resistance of a liquid to effect a time delay.

2. Description of the Prior Art

It is frequently desirable to control the operation of electrical devices, such as lighting systems, by means of switches which operate on a predetermined time delay. Some of the known switches for this purpose, such as that shown in U.S. Pat. No. 3,020,363, issued Feb. 6, 1962, to J. T. Gurney, Sr., utilize mechanical rather than thermal or electrical time delay means in order to obtain the desired time delay interval. Further, many prior art devices use gravity operated mechanisms in order to realize a time delay function, with examples of these latter devices being found in U.S. Pat. Nos. 1,817,806, issued Aug. 4, 1931, to R. D. Delamere; 2,209,253, issued July 23, 1940, to W. C. Strungart; 2,437,197, issued Mar. 2, 1948, to C. B. Ivester; and 2,755,349, issued July 17, 1956, to C. H. Silvers.

SUMMARY OF THE INVENTION

It is an object of the present invention to provide a time delay switch which operates independently of mechanical mechanisms, and the like.

It is another object of the present invention to provide a time delay switch which does not use mercury or other conducting liquid therein.

It is yet another object of the present invention to provide a time delay switch of simple, yet rugged and reliable construction, and which is inexpensive of manufacture and simple to use.

These and other objects are achieved according to the present invention by providing a time delay switch having: a hollow housing forming a liquid reservoir; an actuator slidably disposed on the housing for movement through the liquid reservoir between a switch open position and a switch closed position; and a spring or other suitable biasing device arranged engaging the actuator for forcing the actuator through the liquid reservoir in a predetermined time from one of the switch open position and the switch closed position to the other position.

The housing preferably includes a hollow cylindrical tube forming a cylindrical bore and having a pair of ends, the cylindrical bore itself defining the liquid reservoir, with one of the ends of the tube being enclosed and the other of the ends being open. A cup-shaped cap is removably arrangeable in inverted orientation on the open other of the ends of the tube, with a hole being provided in the cap for slidably receiving the actuator. The housing advantageously further includes a pair of substantially identical contacts, each having a U-shaped portion including a pair of substantially parallel, spaced legs arranged in gripping engagement in opposed relation on the open other of the ends of the tube for one of each pair of legs being wiped selectively by the actuator when same is in the switch closed position. The other of the legs of each U-shaped portion of the contacts is connectible to an associated electrical circuit. The cap fits over the other of the legs of each U-shaped portion of the contacts in order to clampingly retain the contacts on the tube of the housing.

The actuator preferably includes a longitudinally extending element, or rod, having longitudinally spaced ends, with a sphere abutting the element at one of the longitudinally spaced ends thereof. A handle or coupling is provided at the other of the longitudinally spaced ends of the element, with the element being slidably disposed in the hole provided in the cap of the housing in such a manner that the sphere is disposed in the liquid reservoir formed by the bore of the tube of the housing.

The rod advantageously is provided thereon with indicia graduated by increments of length, and the time delay of the switch is determined by the length of displacement of the sphere within the tube, as measured by the indicia on the rod, which displacement is effected by appropriate movement of the handle of the actuator, away from the contacts and against the bias of the spring or other resilient biasing device.

As used herein, the word liquid is intended to include in addition to water, oil, and the like, fluent particulate material such as powdered polytetrafluoroethylene.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
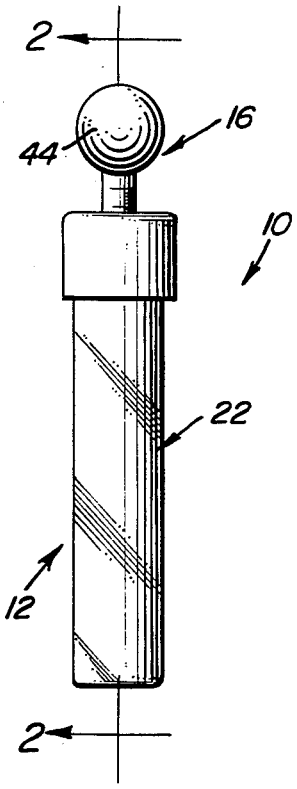
FIG. 1 is a schematic, side elevational view showing a time delay switch according to the present invention.
Figure 2:
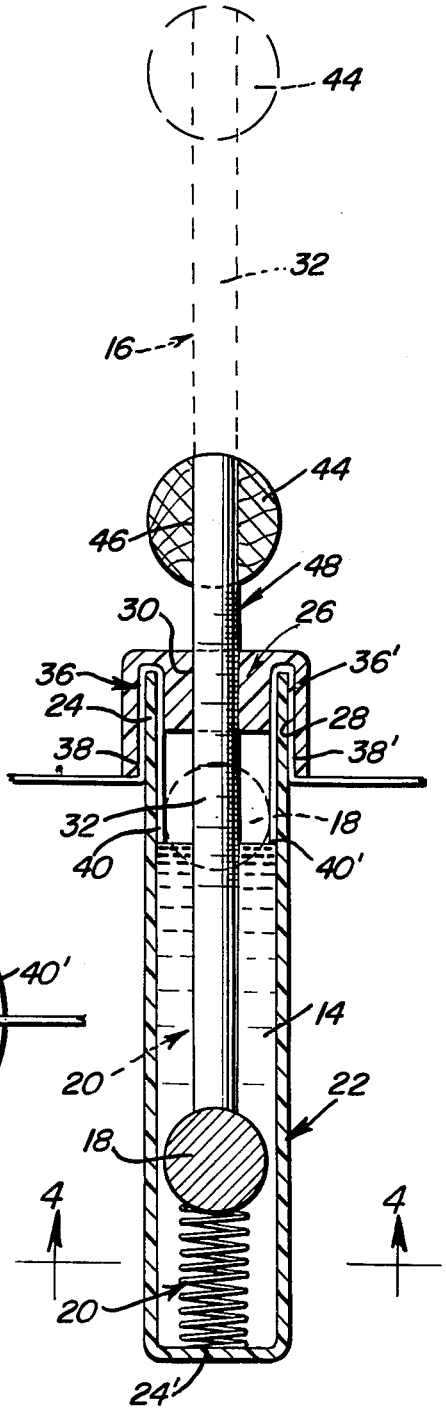
FIG. 2 is an enlarged, fragmentary, sectional view taken generally along the line 2—2 of FIG. 1.

Referring now more particularly to the figures of the drawing, a time delay switch 10 according to the present invention includes a hollow housing 12 forming a liquid reservoir 14. An actuator 16 is slidably disposed on housing 12 for movement through reservoir 14, while disposed in reservoir 14 is a sphere 18 arranged for movement between a switch open position and a switch closed position. As seen in FIG. 2, the switch open position is that shown in full lines and the switch closed position is that shown in broken lines. A helical coiled spring 20, or other suitable biasing device, engages sphere 18 for forcing same through reservoir 14 in a predetermined time from a switch open position, in the illustrated embodiment, to a switch closed position. It is to be understood that the basic operating principles of a time delay switch according to the present invention, will permit same to move from a switch closed position to a switch open position in a predetermined time, if desired.

Housing 12 includes a hollow, cylindrical tube 22 forming a cylindrical bore and having a pair of longitudinally spaced ends 24 and 24'. End 24' is enclosed, while end 24 is open, with a cup-shaped cap 26 being removably arranged in inverted orientation on open end 24. Cap 26 includes a cavity 28 of generally cylindrical configuration and slightly larger than the outer diameter of tube 22 in order to fit over open end 24, and is also provided with a hole 30 which slidably receives a longitudinally extending element in the form of a rod 32 which partially forms actuator 16.

Housing 12 further includes a pair of substantially identical contacts 34, 34', each of which contacts has a U-shaped portion 36, 36', respectively, including a pair of substantially parallel, spaced legs 38, 38' and 40, 40'. The latter are arranged in resilient gripping engagement with and in opposed relation on the open end 24 of tube 22 for the legs 40, 40' to be selectively wiped by sphere 18. As can be appreciated, when the sphere 18 is in wiping engagement with legs 40, 40' of the contacts 34, 34', themselves arranged in electrical contact with an electrical circuit (not shown) in which switch 10 is inserted, the switch 10 will be in its closed position. Otherwise, switch 10 will be in its open position.

Figure 3:
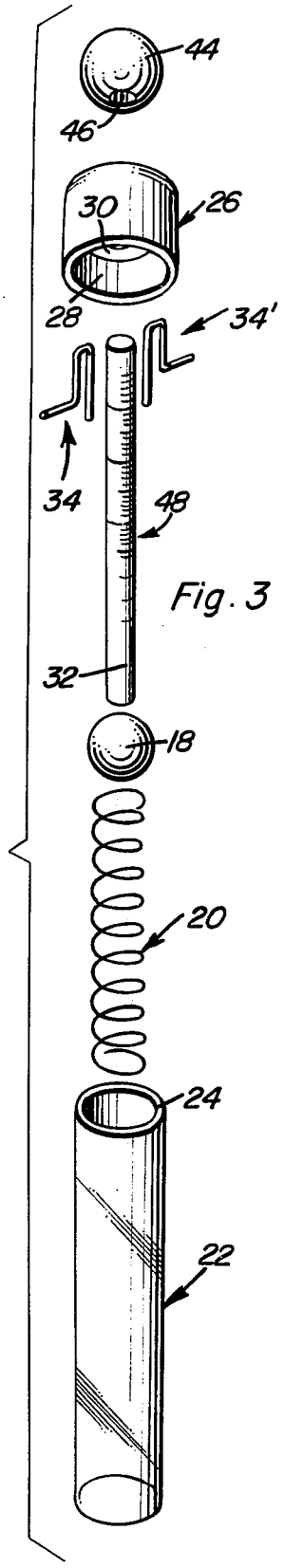
FIG. 3 is an exploded, perspective view showing the time delay switch of FIG. 1.
Figure 4:
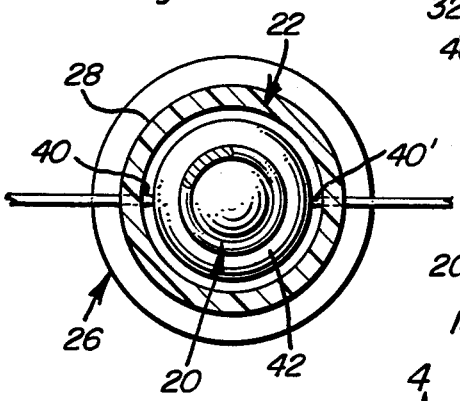
FIG. 4 is an enlarged, fragmentary, sectional view taken generally along the line 4—4 of FIG. 2.

Cavity 28 of cap 26 is dimensioned so that cap 26 fits over the outer legs 38, 38' of contacts 34, 34' for clampingly retaining the contacts 34, 34' on tube 22, which arrangement can best be seen in FIGS. 2 and 3.

Actuator 16 includes, in addition to rod 32, a handle 44 which can be of the illustrated spherical configuration and which is provided with an opening 46 received on the other of the ends of rod 32 as by a force fit for retention with respect to the rod 32. As can be seen from FIG. 2, sphere 18 is disposed in the liquid reservoir 14 formed by tube 22 of housing 12, and movement of the sphere 18 upwardly under the bias of compressed spring 20 from the position shown in full lines in FIG. 2 to the position shown in broken lines therein will be against the resistance afforded by the particular liquid placed in reservoir 14, and the time delay of switch 10 can be varied by changing the viscosity of such liquid. Conventional motor oils and other suitable petroleum products have been found satisfactory for use as the liquid in reservoir 14. In addition, rod 32 advantageously is provided on the outer surface thereof with indicia 48 graduated by increments of length of tube 22 along the longitudinal extent thereof, such that time delay of switch 10 can be determined, and varied, by the length of displacement of sphere 18 away from the contacts 34, 34' against the bias of spring 20. Indicia 48 is sighted with the top of cap 26.

In operation, once actuator 16 has pushed sphere 18 against spring 20 a desired distance, as measured by indicia 48, rod 32 is pulled back in order to permit sphere 18 to move freely through reservoir 14 under the bias of spring 20 at a rate determined by the resistance to flow of the substance in reservoir 14.

As can be readily understood from the above description and from the drawings, a time delay switch according to the present invention can operate in any position and does not depend upon gravity for its actuation, although if the actuator were exceptionally heavy there may be some small effect from gravity when the switch is in the inverted position. The invention can be placed on a chassis, and the like, with only the handle protruding. The actuating mechanism of a switch according to the invention is very simple, and can be accomplished in several ways, not shown, other than the illustrated manually manipulatable handle 44. For example, a solenoid could be connected to rod 32 to operate the switch remotely, or a screw or telescoping type of actuator rod similar to those used for some automobile jacks could be used so that the spherical handle 44 could be turned rather than longitudinally reciprocated. A hollow plunger or rod could be used with a small spring placed in the hollow portion of the rod and attached to the sphere or other contact closing element so that the sphere would be pulled into operative position rather than pushed. In addition, a circular tube or long straight tube could be used with any long cord attached to the sphere and to a winding mechanism for setting and resetting of the switch.

It will be appreciated that the contacts 34, 34' and sphere 18 must be constructed from a suitable electrically conductive material, such as aluminum, copper, brass, and the like, in order to complete an electrical circuit through sphere 18 between the contacts 34, 34' when the switch is in its closed position.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A time delay switch, comprising, in combination:

(a) a hollow housing forming a liquid reservoir;

(b) actuator means slidably disposed within the housing for movement relative thereto;

(c) contact means floatingly mounted within the housing for movement relative to the inner housing cavity and separable from but operatively engaged with said actuator means, said contact means assuming a switch open position or a switch closed position in response to the disposition of said actuator means within the housing; and (d) biasing means operatively engaged with the contact means for forcing the contact means through the liquid reservoir in a predetermined time from one of the switch open position and the switch closed position to the other position in response to a change in position of said actuator means, wherein the housing includes a hollow, cylindrical tube forming a cylindrical bore and having a pair of ends, one of which ends is enclosed and the other of which ends is open, and a cup-shaped cap removably arranged in inverted orientation on the open end of the tube, with a hole being provided in the cap and arranged slidably receiving the actuator means.

2. A structure as defined in claim 1, wherein the housing further includes a pair of substantially identical contacts each having a U-shaped portion including a pair of substantially parallel, spaced legs arranged in gripping engagement and in opposed relation on the open other of the ends of the tube for being wiped by the actuator means when the actuator means is in the switch closed position, the cap of the housing fitting over an outer leg of each of the contacts and clampingly retaining the contacts on the tube of the housing.

3. A structure as defined in claim 2, wherein the actuator means includes a longitudinally extending element having longitudinally spaced ends, the contact means including a sphere constructed from an electrically conductive material and disposed between a one of the longitudinally spaced ends of the element and the enclosed one of the ends of the tube, the one of the longitudinally spaced ends of the element selectively abutting the sphere for forcing the sphere toward the enclosed one of the ends of the tube against the bias of the biasing means, and a handle provided at the other of the longitudinally spaced ends of the element, the element being slidably disposed in the hole provided in the cap of the housing, and the sphere being disposed in the liquid reservoir formed by the tube of the housing for electrically contacting the inner legs of the contacts when the sphere is in the switch closed position.

4. A structure as defined in claim 3, wherein the biasing means includes a helical coiled spring arranged within the tube and abutting the enclosed one of the ends of the tube, with the spring engaging the sphere for biasing same toward the open one of the ends of the tube and into electrical contact with the contacts of the housing.

5. A structure as defined in claim 4, wherein the longitudinally spaced element is provided thereon with indicia graduated by increments of length, and the time delay of the switch being determined by the length of displacement of the sphere by movement of the handle of the actuator means toward the open one of the ends of the tube and engaging the element against the sphere, and the associated contacts, against the bias of the spring, the spring subsequently forcing the sphere back toward the contacts against the resistance created by the resistance of a liquid in the liquid reservoir formed by the tube of the housing.

6. A time delay switch, comprising, in combination:

(a) a hollow housing forming a liquid reservoir;

(b) actuator means slidably disposed within the housing for movement relative thereto;

(c) contact means floatingly mounted within the housing for movement relative to the inner housing cavity and separable from but operatively engaged with said actuator means, said contact means assuming a switch open position or a switch closed position in response to the disposition of said actuator means within the housing; and (d) biasing means operatively engaged with the contact means for forcing the contact means through the liquid reservoir in a predetermined time from one of the switch open position and the switch closed position to the other position in response to a change in position of said actuator means; wherein the biasing means includes a helical coil spring arranged within the housing and engaging the contact means for forcing the contact means through the liquid reservoir against the resistance created by the viscosity of a liquid within the reservoir.

7. A time delay switch, comprising, in combination:

(a) a hollow housing forming a liquid reservoir:

(b) actuator means slidably disposed within the housing for movement relative thereto;

(c) contact means floatingly mounted within the housing for movement relative to the inner housing cavity and separable from but operatively engaged with said actuator means, said contact means assuming a switch open position or a switch closed position in response to the disposition of said actuator means within the housing; and (d) biasing means operatively engaged with the contact means for forcing the contact means through the liquid reservoir in a predetermined time from one of the switch open position and the switch closed position to the other position in response to a change in position of said actuator means; wherein the actuator means is provided thereon with indicia graduated by increments of length along an extent of the actuator means.

8. A time delay switch, comprising, in combination: a hollow housing forming a liquid reservoir; actuator means including a longitudinally extending element having longitudinally spaced ends and slidably disposed within the housing; contact means including a sphere slidably disposed in the liquid reservoir formed by the housing for movement through the liquid reservoir between a switch open position and a switch closed position in response to the disposition of said actuator means on the housing; and, biasing means engageable with the actuator means for forcing the contact means through the liquid reservoir in a predetermined time from one of the switch open position and the switch closed position to the other position in response to a change in position of said actuator means.

9. A structure as defined in claim 8, wherein the biasing means includes a helical coil spring arranged within the housing and abutting the sphere for forcing the sphere through the liquid reservoir against the resistance created by the viscosity of the liquid within the reservoir.

* * * * *